US010588341B2

(12) United States Patent
Chen et al.

(10) Patent No.: US 10,588,341 B2
(45) Date of Patent: Mar. 17, 2020

(54) WRAPPERS FOR SMOKING ARTICLES

(71) Applicants: Schweitzer-Mauduit International, Inc., Alpharetta, GA (US); LTR Industries, Quimperle (FR)

(72) Inventors: Cai Chen, Alpharetta, GA (US); Michel Barale, Quimperle (FR)

(73) Assignee: SCHWEITZER-MAUDUIT INTERNATIONAL, INC., Alpharetta, GA (US)

( * ) Notice: Subject to any disclaimer, the term of this patent is extended or adjusted under 35 U.S.C. 154(b) by 11 days.

(21) Appl. No.: 15/102,703

(22) PCT Filed: Dec. 10, 2014

(86) PCT No.: PCT/US2014/069439
§ 371 (c)(1),
(2) Date: Jun. 8, 2016

(87) PCT Pub. No.: WO2015/089128
PCT Pub. Date: Jun. 18, 2015

(65) Prior Publication Data

US 2016/0302474 A1 Oct. 20, 2016

Related U.S. Application Data

(60) Provisional application No. 61/934,062, filed on Jan. 31, 2014, provisional application No. 61/914,773, filed on Dec. 11, 2013.

(51) Int. Cl.
*A24D 1/02* (2006.01)
*A24C 5/00* (2020.01)
(Continued)

(52) U.S. Cl.
CPC ..... *A24D 1/02* (2013.01); *A24C 5/005* (2013.01); *A24D 1/002* (2013.01); *A24D 1/025* (2013.01); *A24D 1/08* (2013.01); *A24D 1/10* (2013.01)

(58) Field of Classification Search
CPC ..... A24D 1/02
See application file for complete search history.

(56) References Cited

U.S. PATENT DOCUMENTS 1,438,587 A 12/1922 Feldenheimer
1,438,588 A 12/1922 Feldenheimer
(Continued)

FOREIGN PATENT DOCUMENTS

AU 2013200653 A1 2/2013
EP 0085494 10/1983

OTHER PUBLICATIONS

Williams, R., pKA Data, Oct. 24, 2001 http://research.chem.psu.edu/brpgroup/pKa_compilation.pdf.
(Continued)

*Primary Examiner* — Eric Yaary
(74) *Attorney, Agent, or Firm* — Dority & Manning, P.A.

(57) ABSTRACT

Described are paper wrappers and smoking articles that can include the paper wrappers. The paper wrapper can include a weak organic acid or salt thereof. The addition of the weak organic acid or salt thereof to the paper wrapper can enhance the sensory characteristics of a smoking article that includes the paper wrapper. For instance, the addition of the weak organic acid can enhance the taste and/or smell of a smoking article that includes the paper wrapper.

17 Claims, 4 Drawing Sheets

(51) Int. Cl.

| | |
|---|---|
| ***A24D 1/00*** | (2020.01) |
| ***A24D 1/08*** | (2006.01) |
| ***A24D 1/10*** | (2006.01) |

(56) References Cited

U.S. PATENT DOCUMENTS

| | | | | |
|---|---|---|---|---|
| 1,905,416 | A | 4/1933 | Low | |
| 2,028,552 | A | 1/1936 | Low | |
| 2,049,320 | A | 7/1936 | Ruben et al. | |
| 2,181,614 | A | 11/1939 | Striefling | |
| 2,933,420 | A | 4/1960 | Haden | |
| 3,049,449 | A | 8/1962 | Allegrini | |
| 3,667,479 | A | 6/1972 | Sanford et al. | |
| 3,744,496 | A | 7/1973 | McCarty et al. | |
| 3,797,504 | A | 3/1974 | Hughes et al. | |
| 3,861,401 | A | 1/1975 | Briskin et al. | |
| 3,987,800 | A | 10/1976 | Aetho et al. | |
| 4,033,359 | A | 7/1977 | Borthwick et al. | |
| 4,108,151 | A | 8/1978 | Mactin et al. | |
| 4,146,040 | A | 3/1979 | Cohn | |
| 4,225,636 | A | 9/1980 | Cline et al. | |
| 4,231,377 | A | 11/1980 | Cline et al. | |
| 4,450,847 | A | 5/1984 | Owens | |
| 4,452,259 | A | 6/1984 | Norman et al. | |
| 4,453,553 | A | 6/1984 | Cohn | |
| 4,461,311 | A | 7/1984 | Matthews et al. | |
| 4,805,644 | A | 2/1989 | Hampl, Jr. et al. | |
| 5,050,622 | A | 9/1991 | Raker et al. | |
| 5,220,930 | A * | 6/1993 | Gentry | A24B 15/282 131/331 |
| 5,385,158 | A | 1/1995 | Owens, Jr. | |
| 5,450,862 | A * | 9/1995 | Baldwin | A24D 1/02 131/365 |
| 5,540,242 | A * | 7/1996 | Chao | A24D 1/02 131/365 |
| 5,820,998 | A | 10/1998 | Hotaling et al. | |
| 5,830,318 | A | 11/1998 | Snow et al. | |
| 5,878,753 | A | 3/1999 | Peterson et al. | |
| 5,878,754 | A | 3/1999 | Peterson et al. | |
| 5,888,348 | A | 3/1999 | Hampl, Jr. | |
| 5,921,249 | A | 7/1999 | Hampl, Jr. | |
| 6,298,860 | B1 | 10/2001 | Hampl, Jr. et al. | |
| 6,305,382 | B1 | 10/2001 | Hampl, Jr. | |
| 6,314,964 | B1 | 11/2001 | Hampl, Jr. | |
| 6,568,403 | B2 | 5/2003 | Hampl, Jr. et al. | |
| 6,584,981 | B2 | 7/2003 | Hampl, Jr. | |
| 6,645,605 | B2 | 11/2003 | Hammersmith et al. | |
| 6,676,806 | B1 | 1/2004 | Butt, Sr. | |
| 6,725,867 | B2 | 4/2004 | Peterson et al. | |
| 6,779,530 | B2 | 8/2004 | Kraker | |
| 6,823,872 | B2 | 11/2004 | Hampl, Jr. | |
| 6,837,248 | B2 | 1/2005 | Zawadzki et al. | |
| 8,151,806 | B2 | 4/2012 | Wanna | |
| 8,353,301 | B2 | 1/2013 | Hampl, Jr. et al. | |
| 8,443,812 | B2 | 5/2013 | Hampl, Jr. et al. | |
| 8,646,464 | B2 | 2/2014 | Hampl, Jr. et al. | |
| 8,807,144 | B2 | 8/2014 | Hampl, Jr. et al. | |
| 8,863,757 | B2 | 10/2014 | Kraker | |
| 8,869,805 | B2 | 10/2014 | Wanna | |
| 9,149,068 | B2 | 10/2015 | Snow et al. | |
| 9,247,769 | B2 | 2/2016 | Snow et al. | |
| 2002/0139381 | A1 * | 10/2002 | Peterson | A24D 1/025 131/365 |
| 2002/0179105 | A1 * | 12/2002 | Zawadzki | A24D 1/025 131/365 |
| 2007/0295348 | A1 * | 12/2007 | Wanna | A24D 1/025 131/365 |
| 2011/0033624 | A1 | 2/2011 | Tsutsumi et al. | |
| 2012/0024303 | A1 * | 2/2012 | Sugai | A24B 15/28 131/290 |
| 2012/0227754 | A1 * | 9/2012 | Norman | A24D 1/025 131/365 |

OTHER PUBLICATIONS

PCT/US2014/069439 International Search Report and Written Opinion dated Mar. 24, 2015, 12 pages.

* cited by examiner

WRAPPERS FOR SMOKING ARTICLES

RELATED APPLICATIONS

This application is the U.S. National Stage entry of International Application Number PCT/US2014/069439 filed under the Patent Cooperation Treaty and having a filing date of Dec. 10, 2014, which claims priority to U.S. Provisional Patent Application Ser. No. 61/934,062 having a filing date of Jan. 31, 2014, and U.S. Provisional Patent Application Ser. No. 61/914,773 having a filing date of Dec. 11, 2013, all of which are hereby incorporated by reference herein in their entirety for all purposes.

BACKGROUND

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and can contain a filler, such as calcium carbonate.

When a smoking article is smoked, mainstream smoke is generated that is inhaled through the filter. Mainstream smoke can contain numerous different components that provide the smoking article with a particular taste, which encompasses the sensations detected not only by one's taste but also by one's sense of smell. In order to provide a smoking article with a particular taste, as many as over 500 different ingredients may be added to the tobacco at different levels. In addition to the components of mainstream smoke that contribute to the taste of the smoking article, the mainstream smoke can also contain various other analytes. For example, D. Hoffmann of the American Health Foundation recognized 44 different analytes that may be present in mainstream smoke. These analytes are typically referred to as "Hoffmann analytes" and include, for instance, ammonia, aminonaphthalenes, benzopyrene, formaldehyde, acetaldehyde, acetone, methyl ethyl ketone, butyraldehyde, hydrogen cyanide, nitrous oxides, tobacco-specific nitrosamines ("TSNAs"), pyridine, quinoline, hydroquinone, phenol, cresols, tar, nicotine, carbon monoxide, 1,3-butadiene, isoprene, acrylonitrile, benzene, toluene, styrene, and various others. It has been determined that some Hoffmann analytes may be unwanted in the mainstream smoke from a smoking article. As such, extensive research has been conducted on reducing Hoffmann analytes.

Besides being used to hold smoking articles together, wrapping papers also contribute to and control many physical properties and characteristics of the smoking article. For instance, cigarette wrapping papers affect the rate at which the cigarette burns, the number of puffs per cigarette, tar, various volatile analytes, and the total tar delivery per puff. What is needed, however, is a cigarette wrapping paper that may additionally be used to reduce the amount of at least one Hoffmann analyte in the mainstream smoke of a smoking article, and in particular, to reduce the amount of carbon monoxide in the mainstream smoke of a smoking article and/or to improve the taste and enjoyment of the smoking article.

SUMMARY

According to one embodiment, disclosed is a paper wrapper for a smoking article. The paper wrapper in one embodiment can have a high porosity, for instance greater than about 40 Coresta units. The paper wrapper can include a weak organic acid or a salt of the weak organic acid. The weak organic acid can generally include four or more carbon atoms. In addition, the weak organic acid can be a monoprotic acid having a $pK_a$ of greater than 4.2 or can be a polyprotic acid having a $pK_{a1}$ of greater than 4.2. The weak organic acid or salt thereof can be present on and/or in the paper in an amount sufficient to improve the taste and/or smell of a smoking article that includes the paper wrapper. In one embodiment, the weak organic acid can be levulinic acid.

According to another embodiment, the paper wrapper can include a first organic acid or salt of the first organic acid and also can include a second organic acid or salt of the second organic acid. The first organic acid is a weaker acid than the second organic acid. For instance, the first organic acid can be an acid as described above and the second organic acid can have a $pK_a$ (or a $pK_{a1}$, in the case of a polyprotic organic acid) of 4.2 or less. In one embodiment, the first organic acid can be levulinic acid and the second organic acid can be lactic acid.

The first and/or second organic acid (or salts thereof) can be applied to the paper wrapper on/in essentially the entire wrapper or only in select areas. For instance, the acids or salts can be independently applied in a pattern, such as in bands over the paper wrapper. In one embodiment, additional materials can be applied to the paper wrapper in conjunction with or independently of the acid(s). For example, a film forming agent that can be used to alter the ignition proclivity can be applied to the paper wrapper, either in conjunction with or independently of the weak and/or the second organic acids (or salts thereof).

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
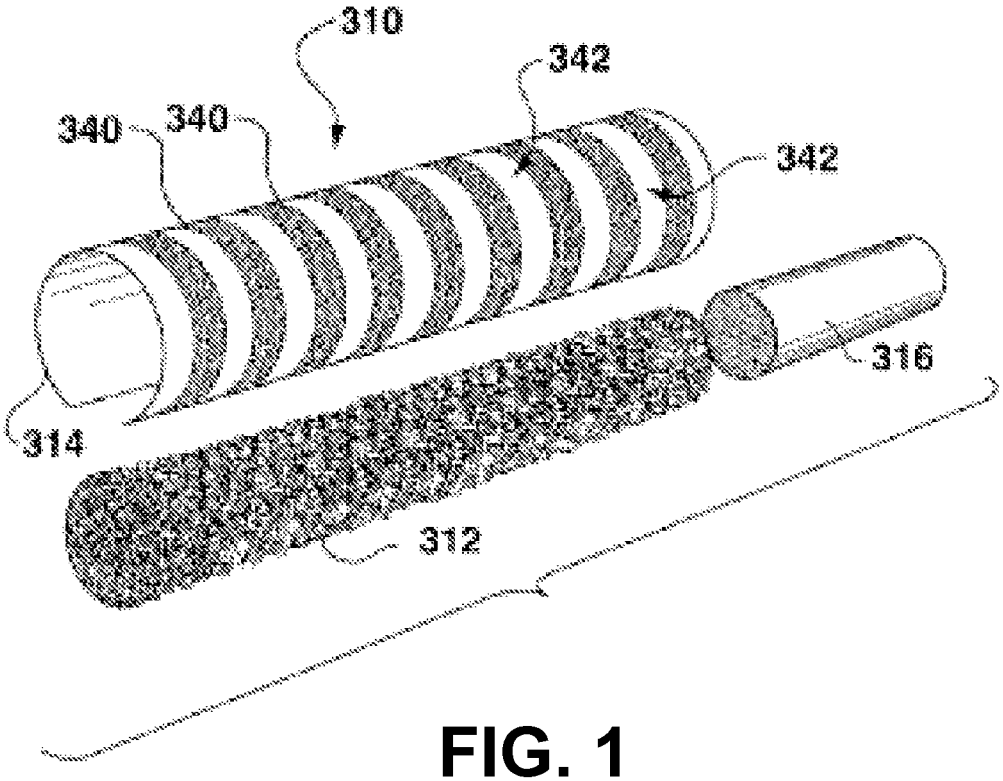
FIG. 1 is an exploded view of a smoking article including a smoking wrapper as described herein.

Repeat use of reference characters in the present specification and drawings is intended to represent same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations.

For purposes of explanation of the invention, the embodiments and principles of the invention will be discussed in regards to a cigarette. However, this is for the purposes of explanation of the invention only and is not meant to limit the invention only to cigarettes. Any manner of smoking article is within the scope and spirit of the invention.

The present disclosure relates to a paper wrapper for a smoking article and smoking articles that include the paper wrapper, the wrapper having a weak organic acid and/or salt thereof applied to the surface and/or impregnated in the paper. The addition of the weak organic acid or salt thereof to the wrapper can enhance the sensory characteristics of the smoking article. In particular, the addition of the weak organic acid can enhance the taste and/or smell of the smoking article. In one embodiment, the addition of the weak organic acid and/or salt thereof to the wrapper can reduce the amount of one or more Hoffmann analytes in the mainstream smoke of the smoking article. For instance, the addition of the weak organic acid or salt thereof to the wrapper can reduce the amount of carbon monoxide in the mainstream smoke of the smoking article. Although unknown, the above effects appear to be optimized when using levulinic acid or a salt of levulinic acid as the weak organic acid or salt thereof.

Although not wishing to be bound by theory, it is believed that the reduced amount of one or more Hoffmann analytes can be caused by the increased acidity of the smoking article due to the presence of the organic acid(s) (and/or salts), which leads to more complete combustion of the smokeable material and/or the fillers when applied to a wrapper with high porosity, i.e., increased production of carbon dioxide and decreased production of carbon monoxide. In addition, the improved taste resulting from the use of the organic acid or salt thereof is believed to be due to the effect of acidic versus alkaline additives on cellulose pyrolysis. Basic additives cause fragmentation of cellulose into lower weight compounds including those often considered detrimental to taste, such as aldehydes and carboxyl compounds. Acidic additives lead to less fragmentation with the production of more levoglucosan derived compounds, which are distillable, and anhydrosugars all of which would be expected to have no adverse effect on taste.

In general, weak organic acids that may be used include those having at least four carbon atoms or at least five carbon atoms in one embodiment. The weak organic acid can be either monoprotic or polyprotic. A monoprotic weak organic acid as may be used can have a dissociation constant, $pK_a$, greater than 4.2 (e.g., about 4.3 or greater, about 4.4 or greater, or about 4.5 or greater), and a polyprotic weak organic acid as may be used can have a first dissociation constant, $pK_{a1}$, greater than 4.2 (e.g., about 4.3 or greater, about 4.4 or greater, or about 4.5 or greater). Examples of weak organic acids include, but are not limited to, levulinic acid, pimelic acid, adipic acid, or a combination of two or more weak organic acids. In one embodiment, the weak organic acid can be levulinic acid. Organic acids not encompassed herein as the weak organic acid include citric acid, succinic acid, and acetic acid.

The acidic salts used can include, but are not limited to calcium, potassium and sodium salts of the weak organic acids. The pH of an aqueous 0.1 molar solution of the acidic salt to be applied to a surface of the wrapper and/or impregnated into the paper can be about 5.5 pH units or less in one embodiment.

Additionally, compounds that are precursors of the weak organic acid can be used as the additive for the paper wrapper. Compounds that thermally decompose to generate the acidic species in situ can be used. Salts of polyvalent acids with at least one labile proton may produce the desired effect in the presence of heat and water vapor. Various esters, including phosphate esters, which are acidic precursors, may be used.

In one embodiment, the weak organic acid and/or salt thereof can be applied to substantially the entirety of the paper wrapper, for instance applied substantially to the entire surface of the paper wrapper and/or impregnated throughout the entire bulk of the paper wrapper. In another embodiment, the weak organic acid and/or salt thereof can be applied to the paper wrapper in a pattern. For instance as shown in FIG. 1, the weak organic acid can be applied to the paper wrapper 314 in areas such as bands 340 formed on or in the wrapper and separated from one another by spaces 342. In the embodiment shown in FIG. 1, the bands 340 are perpendicular to the axis of the wrapper 314 when formed for the cigarette 310. In other embodiments, however, it should be appreciated that the bands may be parallel to the axis of the smoking article or may be placed on the wrapper in a spiral arrangement. In still further embodiments, the weak organic acid areas 340 may appear on the wrapper 314 in any type of suitable pattern that includes the weak organic acid areas 340 separated from one another.

In the embodiment shown in FIG. 1, the weak organic acid areas 340 form bands that are spaced apart from each other longitudinally along the length of the wrapper 314 that wraps the smoking material 312. In one embodiment, the weak organic acid areas 340 can be essentially invisible in the formed cigarette that includes the filter 316. In other words, a smoker may not discern from any outward sign that the wrapper 314 includes the weak organic acid areas 340. This is not a requirement however, and in another embodiment the areas can be visible or otherwise discernible.

When provided as bands as shown in FIG. 1, the width and spacing of the bands can vary. For some applications, for instance, the bands may have a width of about 2 millimeters or more, for instance about 3 millimeters or more, such as from about 2 millimeters to about 10 millimeters. In general, band spacing of from about 1 millimeter to about 30 millimeter can be utilize and in one embodiment, from about 10 millimeters to about 25 millimeters.

The manner in which the weak organic acid or salt thereof is applied to the paper wrapper, either over the entire paper or in select areas of the paper, can vary. For example, an aqueous solution of the weak organic acid or salt can be sprayed, brushed or printed onto the wrapper. In one embodiment, the paper can be passed through a pressure roller following application of a solution of the weak organic acid or salt thereof to the paper so as to impregnate the weak organic acid into the bulk of the paper. A solution can be applied in a single pass or in a multiple pass operation. For instance, a solution can be applied to the paper wrapper in successive steps. In general, during a multiple pass process, a solution can be applied in from about 2 to about 8 passes.

The amount of weak organic acid and/or salt thereof that is added to the paper wrapper can depend upon various factors, including the type of weak organic acid and/or salt thereof that is applied. In one application, an about 0.05 wt. % to about 5 wt. % aqueous solution of the weak organic acid or salt thereof can be added to the paper in an amount from about 1% to about 100% by weight of the paper and in one embodiment from about 10% to about 80% by weight of the paper. The paper wrapper can generally include the weak organic acid and/or salt thereof in an amount of from about 0.05% to about 5% by weight of the paper wrapper, such as from about 0.2% to about 4% by weight of the paper wrapper, or from about 0.5% by weight to about 3% by weight of the wrapper in some embodiments, or from about 1% by weight to about 2.5% by weight of the wrapper in some embodiments. Of course the exact amount of the weak organic acid and/or salt thereof to be used can vary depending on the particular acid and/or salt thereof used as well as any pattern of application for the weak organic acid and/or salt thereof.

Upon addition of a weak organic acid to the paper wrapper, the acid can remain in the form as applied or can interact with other components of the paper wrapper. For instance, upon application of the acid, the acid can dissociate to form a salt of the acid on/in the paper wrapper. By way of example, upon application of a levulinic acid to the paper wrapper, the levunate salt of the acid can be formed from some or all of the acid. Thus, the paper wrapper can carry the salt, optionally in conjunction with an amount of the acid as applied.

Figure 2:
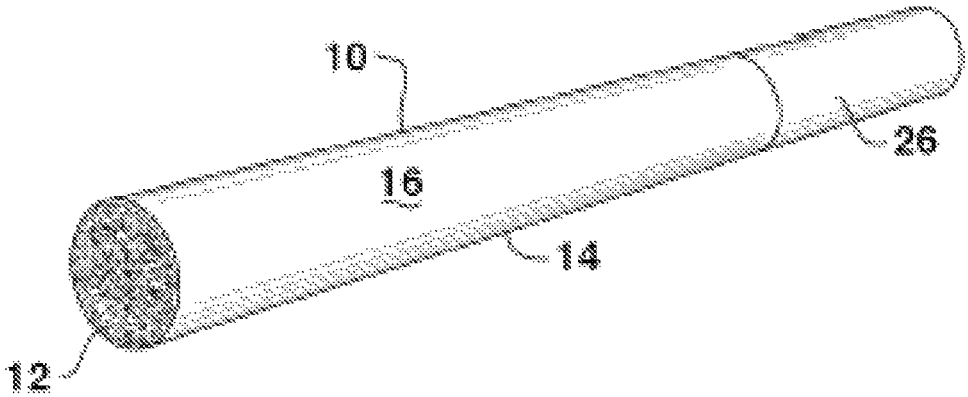
FIG. 2 is a perspective view of a smoking article including a wrapper made in accordance with the present invention.
Figure 3:
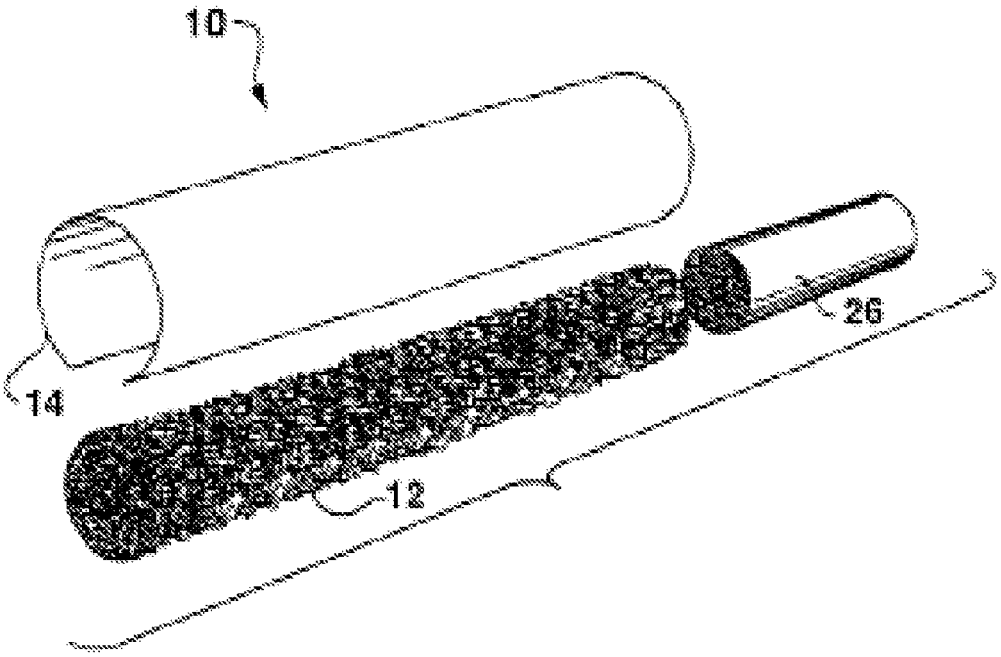
FIG. 3 is an exploded view of the smoking article illustrated in FIG. 2.

In order to assist in describing and explaining the present invention, one embodiment of the invention is illustrated generally in FIGS. 2 and 3. A smoking article (cigarette), generally 10, having a reduced delivery of at least one Hoffmann analyte includes a tobacco column 12 within a paper wrapper 14. Article 10 may include a filter 26. Paper wrapper 14 may include any manner of commercially available cigarette wrapper. For example, the paper wrapper can be made from cellulosic fibers obtained, for instance, from flax, softwood or hardwood. In order to vary the properties of the paper as desired, various mixtures of cellulosic fibers can be used. The extent to which the fibers are refined can also be varied.

The smoking article with which the paper wrapper may be used may be of any length or circumference. For example, the circumference of a cigarette may be in the range from about 15 millimeters to about 25 millimeters. In addition, the smoking article with which the paper wrapper may be used may contain various smokeable materials such as tobacco, expanded tobacco, a variety of tobacco blend types, reconstituted tobacco materials, non-tobacco filler materials and combinations thereof.

For most applications, the paper wrapper can contain a filler. The filler can be, for instance, calcium carbonate, magnesium oxide, calcium chloride, calcium lactate, calcium gluconate, or any other suitable material.

The total filler loading added to the paper wrapper can generally be between about 10% to about 40% by weight. As mentioned, a filler can interact with additives to form a salt on/in the paper wrapper. For example, an acid applied to the paper can interact with a filler to form a salt of the acid on/in the paper wrapper.

The permeability of a paper wrapper for smoking articles made according to the present invention can generally be greater than about 40 Coresta units, for instance from about 40 Coresta units to about 120 Coresta units. In some applications, the permeability can be from about 45 Coresta units to about 100 Coresta units. In various embodiments, for example the initial permeability of the paper wrapper (i.e., prior to any coating formed thereon) may be greater than about 70 Coresta units, greater than about 80 Coresta units, greater than about 90 Coresta units, or greater than about 100 Coresta units.

The basis weight of the paper wrapper can generally be less than about 40 grams per square meter, for instance from about 20 grams per square meter to about 40 grams per square meter, or from about 25 grams per square meter to about 35 grams per square meter.

In addition to applying the weak organic acid and/or a salt thereof to the paper wrapper (i.e., on and/or impregnated in the paper wrapper), in one embodiment the paper wrapper may be treated with a second organic acid and/or a salt of the second organic acid. The second organic acid can be stronger than the first organic acid. For instance, the second organic acid can be a monoprotic acid having a $pK_a$ of 4.2 or less or a polyprotic acid having a $pK_{a1}$ of 4.2 or less. In one embodiment, the $pK_a$ or $pK_{a1}$ of the second organic acid can be from about 1 to 4.2, or from about 1.5 to about 4. Examples of a second organic acid as may be utilized can include, without limitation, malonic acid, lactic acid, malic acid, citric acid, galacturonic acid, glutaric acid, succinic acid, or a combination of two or more organic acids. A salt of the second organic acid can be, for example, a calcium, sodium, or potassium salt of the second organic acid. In one embodiment, the second organic acid can be lactic acid. By way of example, one embodiment of the paper wrapper can include levulinic acid as the first organic acid and lactic acid as the second organic acid.

The second organic acid and/or salt thereof may be applied over and/or impregnated into substantially the entire surface area of the paper wrapper or in select areas of the paper wrapper (e.g., bands), either in conjunction with the first organic acid and/or salt thereof (e.g., together in a single aqueous solution) or separately, as desired. For instance one of the organic acids or salt thereof can be applied to the surface of the paper wrapper and the other organic acid or salt thereof can be impregnated into the paper wrapper. Moreover, one or both of the organic acids or salts thereof can be both on the surface and impregnated into the paper wrapper. The organic acids can independently be provided in the acid form or in the form of the salts of the acids. For example, the weak organic acid can be applied to the paper wrapper and a salt of the second organic acid can be applied to the paper, or vice versa. In another embodiment, both materials can be applied in the acid form or both materials can be applied in the salt form. Mixtures of the salts and the acids are also encompassed herein. Moreover, in one embodiment the acid can be applied to the paper wrapper and at least a portion of the acid can form a salt of the acid following application of the acid to the paper wrapper. By way of example, upon application of lactic acid to the paper wrapper, all or a portion of the lactic acid can interact with another component of the paper wrapper or a material applied to the paper wrapper, such as a calcium carbonate filler, to form a lactate salt (e.g., a calcium lactate salt) of all or a portion of the lactic acid.

In one embodiment, a mixture of the two organic acids can be applied in select areas of the paper wrapper, e.g., in bands spaced on the paper wrapper as previously described. Alternatively, one of the organic acids can be applied in a pattern on or in the paper wrapper, and the other organic acid can separately be applied over substantially all of the paper wrapper or in a pattern that is the same or different as the pattern of the first organic acid. For example, a solution including the weak organic acid or salt thereof can be applied to select areas of the paper wrapper and a second solution including the second organic acid or salt thereof can separately be applied in select areas of the paper wrapper. The select areas for the weak organic acid can be the same as the select areas for the second organic acid (i.e., the two solution are applied to the same areas one after the other) or the select areas for the weak organic acid can be different from the select areas of the second organic acid. Moreover, when two different patterns of select areas are utilized in applying the materials to the paper wrappers, the two areas can overlap in part.

The second organic acid and/or a salt of the second organic acid may be applied on and/or in the paper wrapper in an amount from about 0.05% to about 5% by weight, such as from about 0.2% to about 2.5% by weight such as from about 0.5% to about 4% by weight of the paper wrapper, or between about 0.8% by weight and about 3% by weight of the wrapper in some embodiments, or between about 1% by weight and about 2.5% by weight of the wrapper in some embodiments. The second organic acid may be added to the paper wrapper in a similar amount as the first organic acid, or in a different amount, as desired, and the exact amount of the second organic acid used can vary depending upon the particular acid used.

The second organic acid and/or a salt thereof may be added onto and/or into the wrapper for various reasons. For example, the second organic acid may be utilized so as to further improve the sensory characteristics of the smoking article, especially the taste and smell of the smoking article.

According to one embodiment, the smoking article can exhibit an improved ignition proclivity. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the cigarette, burn its entire length without igniting the fabric, or self-extinguish before igniting the test fabric or burning its entire length.

Another test for ignition proclivity is referred to as the "Cigarette Extinction Test". The Cigarette Extinction Test is ASTM Test No. E2187-04. In the Cigarette Extinction Test, a lit cigarette is placed on ten layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

According to one embodiment, smoking articles having reduced ignition proclivity can include a film-forming composition on all or a portion of the paper wrapper so as to form lower permeability areas. In one embodiment, the film-forming composition can include a film-forming material blended with a burn promoting agent. In addition, in one embodiment the film-forming composition can be free of any burn retardant. In another embodiment, a smoking article having reduced ignition proclivity can include other materials that can reduce the ignition proclivity. For instance, the paper wrapper can include cellulose fibers or ignition proclivity reducing particles that have been added in areas of the paper wrapper.

In those embodiments in which a film-forming composition is applied to all or a portion of the paper wrapper to form lower permeability areas, film-forming materials that can optionally be used in conjunction with a burn promoting agent can include, without limitation, alginates, guar gum, pectin, polyvinyl alcohol, polyvinyl acetate, cellulose derivatives such as ethyl cellulose, methyl cellulose, and carboxymethyl cellulose, starch, starch derivatives, and the like. Alginates as may be utilized can include a derivative of an acidic polysaccharide or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccharides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof. In one embodiment, an acidified solution of a salt and/or a derivative of alginic acid can be utilized. For example, an acidified solution having a pH of less than about 4 or less than about 3 may be utilized. For instance, an acidified solution of sodium alginate having an alginate concentration of about 4% or less by weight, or about 3% or less by weight, or from about 1% to about 3% by weight can be utilized.

In one embodiment, the film forming agent can be applied and interact with polyvalent metal cations to form a polymer film coating. For instance, an acidified solution of the film forming agent, e.g., a salt or a derivative of alginic acid, can be applied to the paper wrapper, and the acidified solution may dissolve a portion of a particulate filler, such as a calcium carbonate filler, to provide polyvalent metal cations, e.g., calcium or magnesium. The particulate filler can be a filler that is provided in the paper wrapper as formed and/or can be applied to the paper wrapper in conjunction with or separately from the film forming agent. The reaction product of the polyvalent metal cations and the film forming agent, e.g. a salt and/or derivative of alginic acid, may vary depending upon the concentration and type of polyvalent metal cations and/or alginate material. In general, the reaction product can form a generally insoluble polymer and can improve the ignition proclivity of the paper wrapper. By way of example, a calcium carbonate filler can be dissolved to provide calcium ions that can interact with the alginate to form a crosslinked calcium alginate polymer coating on the paper wrapper.

In one embodiment, a solution including the polyvalent metal cations can be added to the paper wrapper in an amount such that the level of polyvalent metal cations can be up to about 10% of the weight of the alginate solids in the application solution. For example the concentration of polyvalent metal cations may be from about 1% to about 8% by weight of the film forming solids in an application solution. When included in the application solution the polyvalent metal cations can partially crosslink the film forming materials. In this embodiment, the application solution may be in the form of a thixotropic gel that can become liquefied during application (e.g., gravure printing), and can re-set following application to form the film on the paper wrapper.

As previously mentioned, the paper wrapper can also include a burn promoting agent. The burn promoting agent, which can be added separately to the paper wrapper or combined and blended with a film forming material, may comprise any suitable substance that enhances the burn rate. Examples of burn promoting agents include alkali metal salts, alkaline earth metal salts, and mixtures thereof. In one embodiment, the burn promoting agent may comprise a salt of a carboxylic acid. In particular examples, for instance, the burn promoting agent may comprise an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, and mixtures thereof. In one particular application, for instance, the burn promoting agent may comprise potassium citrate, sodium citrate, potassium succinate, sodium succinate, or mixtures thereof. The burn promoting can be applied over substantially the entire surface area of the paper wrapper or a portion thereof and need not be intimately incorporated into the film-forming composition prior to application to the paper.

A reduced ignition proclivity film-forming composition is not limited to this embodiment, however. Film forming compositions that can reduce the ignition proclivity of a smoking article as may be incorporated in the disclosed smoking articles can include those disclosed in U.S. Pat. Nos. 6,779,530 and 6,725,867, which are both incorporated herein by reference. As discussed, other materials such as particles and cellulose fibers can also be utilized to form a reduced ignition proclivity paper wrapper.

The reduced ignition proclivity film-forming composition, optionally including polyvalent metal cations and/or a burn promoting agent, can be applied to substantially the entire paper wrapper or within select areas, as desired to form the lower permeability areas. For instance, the lower permeability areas can form bands that are spaced apart from each other longitudinally along the length of the wrapper as described above for the organic acid or salt thereof. For most applications, the lower permeability areas can be essentially invisible in the formed cigarette.

When applied as bands, the width and spacing of the lower permeability bands can be dependent upon a number of variables, such as the initial permeability of the wrapper, density of the tobacco column, etc. The lower permeability bands can have a width so that oxygen is limited to the burning coal for a sufficient length of a period of time to extinguish the coal. In other words, if the bands are too narrow, the burning coal would burn through the bands before self-extinguishing when placed on an adjacent surface. For some applications, for instance, the lower permeability bands may have a width of at least 3 millimeters, such as from about 5 millimeters to about 10 millimeters.

The spacing between lower permeability bands is also a factor of a number of variables. The spacing should not be so great that a cigarette burns for a sufficient length of time to ignite a substrate before the coal ever burns into a lower permeability area. The spacing between the bands also affects the thermal inertia of the burning coal, or the ability of the coal to burn through the bands without self-extinguishing. In general, band spacing of between about 1 millimeter to about 30 millimeter are appropriate and particularly, between about 10 millimeters to about 25 millimeters.

The film forming composition can be applied in conjunction with the weak organic acid and/or the second organic acid or separately, as desired. For instance, in one embodiment the film forming composition can be applied to the paper wrapper, optionally in conjunction with polyvalent metal cations, in select areas (e.g., bands) and a mixture of the weak organic acid (and/or salt thereof) and the second organic acid (and/or the salt thereof) can be applied separately, either substantially over the entire paper wrapper, in the same pattern or in a different pattern, as desired.

In another embodiment, the film forming agent can be combined in conjunction with one or more organic acids (and/or salts thereof) to form a first application solution, and the same or a different film forming agent can be applied separately in a second application solution; the first and second application solutions being applied to the same areas of the paper wrapper, to different areas of the paper wrapper, or to partially overlapping areas of the paper wrapper. Moreover, the film forming agent of each solution can optionally be applied in conjunction with polyvalent metal cations, as described.

Any combination of the various components can be utilized to form a single application solution or multiple application solutions for application to either select areas or substantially all of a paper wrapper. Moreover, there is no particular order for application of multiple materials to a paper wrapper, and the weak organic acid can be applied to a paper wrapper in conjunction with or independently of a second organic acid and/or a film forming agent in any order and according to any combination of select areas or covering essentially the entire paper wrapper.

FIG. 4 presents several exemplary scenarios for application of a weak organic acid (or a salt thereof) with other components to a paper wrapper. By way of example, FIG. 4A illustrates an embodiment in which a first solution 30 that is an aqueous solution including both the salt of a weak organic acid and the salt of a second organic acid (e.g., calcium levulinate and calcium lactate) is applied to a paper wrapper 14 in a select area (e.g., a band). A second solution 32 including a film forming agent (e.g., sodium alginate) is separately applied to the paper wrapper at the same select location as the first solution 30. The resulting paper wrapper (formed as indicated by the large directional arrow) includes a band 34 that includes a higher proportion of the organic acid salts in a lower layer 36 on the paper wrapper and a higher proportion of the film forming agent in an upper layer 38 on the paper wrapper.

Figure 4A:
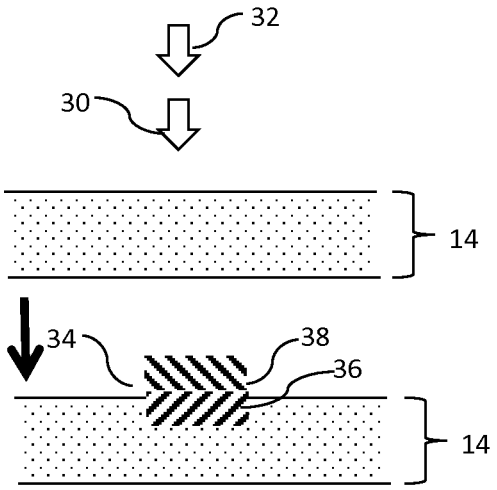
FIG. 4 presents several scenarios for application of a weak organic acid (or salts thereof) to a wrapper as described herein including separate application of a first solution of multiple organic acid salts and a second solution of a film forming agent (FIG. 4A); separate application of a first solution of a film forming agent and a second solution of a film forming agent mixed with multiple organic acids (FIG. 4B); application of a single solution including a film forming agent and multiple organic acids (FIG. 4C); application of a single solution including multiple organic acids (FIG. 4D); and application of a single solution including a film forming agent and a weak organic acid (FIG. 4E).
Figure 4B:
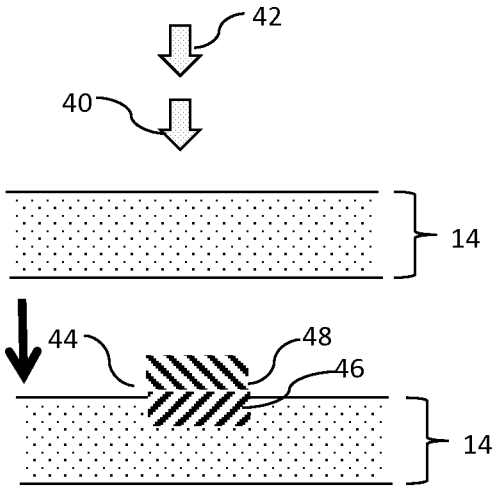

In the embodiment of FIG. 4B, a first solution 40 that includes a film forming agent (e.g., sodium alginate) in combination with a particulate (e.g., calcium carbonate) that can provide polyvalent metal cations can be applied to a paper wrapper 14 in a select area (e.g., a band). A second solution 42 that includes a film forming agent in combination with a weak organic acid and a second organic acid can be separately applied to the paper wrapper at the same select location as the first solution 40. The resulting paper wrapper includes a band 44 that includes a higher proportion of the crosslinked polymer film (calcium alginate) in a lower layer 46 on the paper wrapper and a higher proportion of the film forming agent (sodium alginate) and the organic acids in an upper layer 48 on the paper wrapper.

Figure 4C:
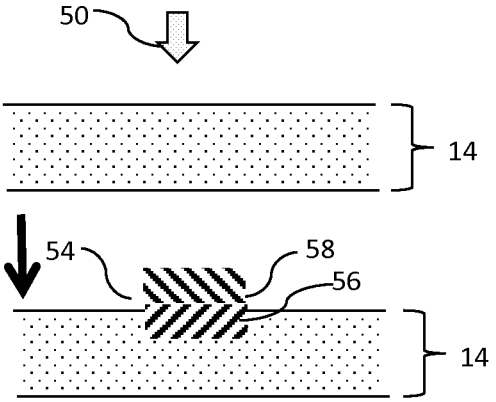

FIG. 4C illustrates an embodiment in which a single solution 50 that includes a film forming agent (e.g., sodium alginate) combined with both a weak organic acid and a second organic acid is applied to the paper wrapper in a select location. In this embodiment, the solution can be acidified and dissolve a filler within the paper (e.g., calcium carbonate) to provide polyvalent metal cations at the application location. The resulting paper wrapper 14 can include a band 54 that includes a higher proportion of the crosslinked polymer film (e.g., calcium alginate) and salts of the organic acids (e.g., calcium salts) in a lower layer 56 on the paper wrapper and a higher proportion of the film forming agent and the organic acids in an upper layer 58 on the paper wrapper.

Figure 4D:
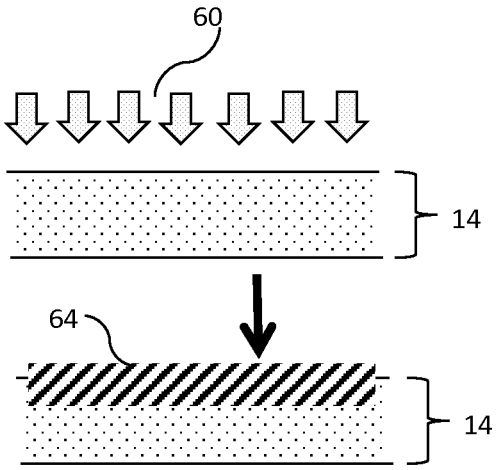

At FIG. 4D is illustrated an embodiment in which a solution 60 including a mixture of a weak organic acid and a second organic acid is applied over essentially the entire surface of the paper wrapper 14. The resulting paper wrapper 14 can thus include a mixture of the organic acids 64 on/in the surface of the paper wrapper 14.

Figure 4E:
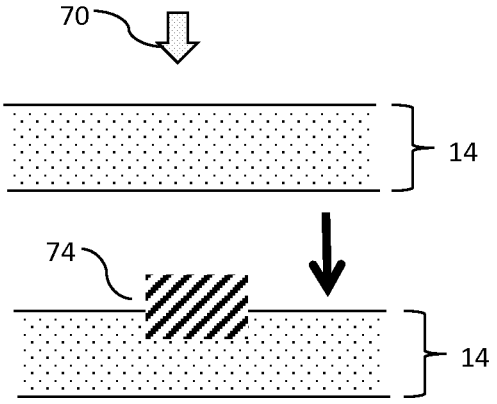

As previously stated, a weak organic acid can be applied to a paper wrapper either with or without a second organic acid. For instance, at FIG. 4E is illustrated an embodiment in which a solution 70 including a weak organic acid in combination with a film forming agent is applied to the paper wrapper in a select location. The resulting paper wrapper 14 can include a band 74 of the weak organic acid and the film forming agent on/in the surface of the paper wrapper 14.

These embodiments present only a few examples of the variations of materials and locations that can be utilized in applying a weak organic acid or a salt thereof to a paper wrapper. A solution including the organic acid(s) can be sprayed, brushed, or printed onto paper, optionally in conjunction with added pressure for forming the wrapper. In general, any suitable application process can be used. After a solution is applied to and/or impregnated into the paper, the paper can be dried, for instance by placing the paper in contact with a steam can.

Besides drying the paper with a hot gas stream or with a steam can, in another embodiment the paper can be dried by contacting the paper with infra-red rays. For example, in one embodiment, the paper can be passed under an infra-red heating lamp. In still another alternative embodiment, the paper can be simply air dried during the drying operation.

These and other modifications and variations to the present invention may be practiced by those of ordinary skill in the art, without departing from the spirit and scope of the present invention. In addition, it should be understood that aspects of the various embodiments may be interchanged both in whole and in part. Furthermore, those of ordinary skill in the art will appreciate that the foregoing description is by way of example only, and is not intended to limit the invention.

What is claimed is:

1. A paper wrapper for a smoking article, the paper wrapper having a basis weight that is less than about 40 grams per square meter, the paper wrapper including a first weak organic acid or acidic salt of the first weak organic acid, wherein the acidic salt of the first weak organic acid comprises a calcium salt of the first weak organic acid, and a second organic acid or salt of the second organic acid, the first weak organic acid being a monoprotic acid having a $pK_a$ greater than 4.2 or a polyprotic acid having a $pK_{a1}$ greater than 4.2, the first weak organic acid including at least four carbons, and the second organic acid being a monoprotic acid having a $pK_a$ of 4.2 or less or a polyprotic acid having a $pK_{a1}$ of 4.2 or less, the paper wrapper having an initial porosity of greater than 40 Coresta units, wherein a film-forming composition is applied to all or a portion of the paper wrapper, wherein the paper wrapper further includes a burn promoting agent or a burn control additive, further wherein the paper wrapper includes an upper layer and a lower layer, wherein the lower layer includes a crosslinked polymer film of the film-forming agent and the upper layer includes a higher proportion of each of the film-forming agent, the first weak organic acid and/or salt thereof, and the second organic acid and/or salt thereof than the lower layer.

2. The paper wrapper of claim 1, wherein the first weak organic acid is not acetic acid, succinic acid, or citric acid.

3. The paper wrapper of claim 1, wherein the first weak organic acid is coated onto a surface of the paper wrapper and/or impregnated into the paper wrapper.

4. The paper wrapper of claim 1, wherein the first weak organic acid and the second organic acid are applied to the paper wrapper in select locations of the paper wrapper.

5. The paper wrapper of claim 1, wherein the first weak organic acid and the second organic acid are applied to the paper wrapper in bands and wherein each band has a width and the width of each individual band is independently from about 2 millimeters to about 10 millimeters and wherein the bands are separated by spaces, the spaces having a width of from about 10 millimeters to about 30 millimeters.

6. The paper wrapper of claim 1, wherein the first weak organic acid comprises levulinic acid, pimelic acid, adipic acid, or a combination of two or more weak organic acids.

7. The paper wrapper of claim 1, wherein the salt of the second organic acid comprises a calcium salt of the organic acid.

8. The paper wrapper of claim 1, wherein the porosity of the paper wrapper is greater than 40 Coresta units and less than 120 Coresta units.

9. The paper wrapper of claim 1, wherein the first weak organic acid is applied over substantially the entire surface of the paper wrapper and/or impregnated into the entire bulk of the paper wrapper.

10. The paper wrapper of claim 1, wherein the burn promoting agent, and/or the burn control additive are included in the paper wrapper in conjunction with the first weak organic acid or separately from the first weak organic acid.

11. The paper wrapper of claim 1, wherein the first weak organic acid comprises levulinic acid, pimelic acid, adipic acid, or a combination of two or more of the first organic acids and wherein the second organic acid comprises malonic acid, lactic acid, malic acid, citric acid, galacturonic acid, glutaric acid, succinic acid, or a combination of two or more of the second organic acids.

12. The paper wrapper of claim 1, wherein the first weak organic acid comprises levulinic acid and the second organic acid comprises lactic acid.

13. The paper wrapper of claim 1, wherein the paper wrapper independently includes each of the first weak organic acid or salt of the first weak organic acid and the second organic acid or salt of the second organic acid in an amount that is from about 0.05% by weight to about 5% by weight of the paper wrapper.

14. The paper wrapper of claim 1, wherein at least one of the first weak organic acid or salt thereof and the second organic acid or salt thereof are independently applied in select areas of the paper wrapper.

15. A smoking article comprising a column of smokeable material and the paper wrapper according to claim 1 surrounding the column of smokeable material.

16. The paper wrapper of claim 1, wherein the first weak organic acid or salt of the first weak organic acid and the second organic acid or salt of the second organic acid are applied to the paper wrapper as a calcium salt of the first weak organic acid and as a calcium salt of the second organic acid.

17. A paper wrapper for a smoking article, the paper wrapper having a basis weight that is less than about 40 grams per square meter, the paper wrapper including a first weak organic acid or acidic salt of the first weak organic acid, wherein the acidic salt of the first weak organic acid comprises a calcium salt of the first weak organic acid, and a second organic acid or salt of the second organic acid, the first weak organic acid being a monoprotic acid having a $pK_a$ greater than 4.2 or a polyprotic acid having a $pK_{a1}$ greater than 4.2, the first weak organic acid including at least four carbons, and the second organic acid being a monoprotic acid having a $pK_a$ of 4.2 or less or a polyprotic acid having a $pK_{a1}$ of 4.2 or less, the paper wrapper having an initial porosity of greater than 40 Coresta units, wherein a film-forming composition is applied to all or a portion of the paper wrapper, wherein the paper wrapper further includes a burn promoting agent or a burn control additive, further wherein the paper wrapper includes an upper layer and a lower layer, wherein the upper layer includes a higher proportion of the film forming agent than the lower layer, and the lower layer includes calcium salt of the first weak organic acid and salt of the second organic acid.

* * * * *